US005464956A

United States Patent [19]

Steele et al.

[11] Patent Number: 5,464,956

[45] Date of Patent: Nov. 7, 1995

[54] ROTATING ARC INTERRUPTER FOR LOADBREAK SWITCH

[75] Inventors: Edward A. Steele, Gurnee; James K. Niemira, Skokie, both of Ill.

[73] Assignee: S&C Electric Company, Chicago, Ill.

[21] Appl. No.: 225,221

[22] Filed: Apr. 8, 1994

[51] Int. Cl.[6] ..... H01H 9/44; H01H 33/18; H01H 1/56

[52] U.S. Cl. ..... 218/29; 218/16; 218/23; 218/26; 218/30; 218/40; 218/48; 218/146; 218/148

[58] Field of Search ..... 200/144 R, 146 R, 200/146 A, 147 R, 147 A, 147 B, 147 C, 147 D, 148 R, 148 B; 218/16–21, 22, 23, 26, 27, 29, 30, 32, 40, 48–50, 146–148, 71–74

[56] References Cited

U.S. PATENT DOCUMENTS

| | | | |
|---|---|---|---|
| 4,032,736 | 6/1977 | Ruffieux et al. | 218/26 |
| 4,109,122 | 8/1978 | Lipperts | 218/142 |
| 4,301,340 | 11/1981 | Parry | 218/23 |
| 4,301,341 | 11/1981 | Parry | 218/28 |
| 4,329,551 | 5/1982 | Bernard et al. | 218/26 |
| 4,338,501 | 7/1982 | Maggi | 218/26 |
| 4,414,450 | 11/1983 | Moll et al. | 218/23 |
| 4,503,302 | 3/1985 | Chrisp | 218/23 |
| 4,514,606 | 4/1985 | Veverka | 218/12 |
| 4,529,853 | 7/1985 | Bouilliez | 218/23 |
| 4,532,392 | 7/1985 | Bouillez et al. | 218/26 |
| 4,665,288 | 5/1987 | Ischi | 218/23 |
| 4,816,624 | 3/1989 | Perrissin et al. | 218/71 |
| 4,918,268 | 4/1990 | Pothieux et al. | 218/26 |
| 4,980,528 | 12/1990 | Spooner | 218/26 |
| 5,001,313 | 3/1991 | Leclerq et al. | 218/76 |
| 5,003,138 | 3/1991 | Bolongeat-Mobleu et al. | 218/26 |
| 5,166,483 | 11/1992 | Kersusan et al. | 218/71 |

*Primary Examiner*—J. R. Scott
*Attorney, Agent, or Firm*—James V. Lapacek

[57] ABSTRACT

A loadbreak switch is provided that utilizes a pivotally mounted movable jaw contact and a main stationary contact that is positioned in the middle of an arc runner. For operation at voltages 15 kV and above, the switch utilizes a shunt contact that bridges the arc runner and that is above and coplanar with the main stationary contact. A magnetic field is developed by the current that flows through a coil of wire disposed around the arc runner. This configuration when utilized in an environment of insulating gas, provides efficient extinguishing of arcs upon opening of the contacts. Further, the open jaw contact is easily visible to establish an open gap.

16 Claims, 4 Drawing Sheets

ROTATING ARC INTERRUPTER FOR LOADBREAK SWITCH

BACKGROUND OF THE INVENTION

1. Field of the Invention

The present invention relates generally to current-interrupting devices for electrical power distribution systems and more particularly to a rotating arc interrupter for a loadbreak switch which utilizes a main stationary contact that is positioned in the middle of an arc runner in the shape of a ring and a shunt contact that bridges the arc runner and that is above and coplanar with the main stationary contact.

2. Description of the Related Art

Various interrupting devices including rotating arc interrupters have been proposed that utilize magnetic fields to perform their functions.

For example, U.S. Pat. No. 4,032,736 is directed to a gas-pressurized electrical switch with a current-generated magnetic field for assisting arc extinction when the cylindrical movable and stationary contacts separate by relative longitudinal movement. An annular intermediate electrode is provided which is connected through a coil to the stationary contact bus. A central conductive pin is provided that is insulated from the other structure. Upon contact separation, arcing first occurs between the contacts and then commutating from the stationary contact to the annular intermediate electrode, with the arcing current flowing through the coil and the arc rotating. The arc then divides such that one part arcs between the movable contact and the central pin and the other part arcing between the central pin and the annular intermediate electrode, that part of the arc continuing to rotate. The arcing heats up the chamber to a positive pressure such that the gas flow extinguishes the arc.

The arrangement of U.S. Pat. No. 4,414,450 utilizes coaxial main contacts and commutation contacts along with compressed gas directed into an expansion chamber to perform an interrupting function. A stationary commutation contact 22 (reference numerals are that of the '450 patent) includes concentric portions, an annular part 221 in the configuration of a nozzle and a second part 222 in the shape of a hollow pin (head with tubular body) that is surrounded by a coil 3. The coil 3 is connected between the hollow pin 222 and the annular part 221. After separation of the main contacts, the current is commutated to the commutation contact 22 and the movable commutation contact 12 carried with the movable stationary contact. When the connection is broken between the commutation contacts, an arc is formed, with the arc being blown by the flow of quenching gas to commutate the arc from the annular portion 221 to the hollow pin portion 222, with current flow now occurring through the coil 3 to the annular portion 221. While the arc is rotated to a negligible extent, energy is pumped from the magnetic field into the random, turbulent gaseous motion of the arc column 5. This leads, in contrast to conventional transversely blown arcs, to the breaking of the arc and to a particularly effective mixing of the arc 5 with the surrounding cold gas. Another rotating arc arrangement with self-extinguishing expansion features is shown in U.S. Pat. No. 5,166,483.

U.S. Pat. No. 4,918,268 is directed to an arc-rotating magnetic-blast coil having a winding 23 with a conductive cup 1 and a conductive disk 21 that is electrically connected to a core of the winding 23. A moving conductive cup 2 and the conductive cup 1 form main contact areas, with arc-runner contact surfaces being provided by the conductive disk 21 of the stationary conductive cup 1 and a conductive disk of the movable conductive cup 2. These arc-runner disks are arranged to stay in contact after separation of the main contacts. When the arc runner disks separate, an arc is struck with current continuing to flow through the winding 23. The arc rotates to aid in current interruption.

The arrangements in U.S. Pat. Nos. 4,301,340 and 4,301,341 operate in an insulating gas environment and include main contacts and an arcing electrode to which an arc is transferred after the opening of the main contacts. The arcing current passes through a field coil to create an arc-rotating magnetic field to extinguish the arc. The structure includes a pivoting main contact which is pivoted into the tubular arcing electrode surrounded by the field coil.

In U.S. Pat. No. 5,003,138, a rotating-arc circuit is provided in parallel with the main contacts. A stationary cylindrical electrode is disposed inside a coil and cooperates with a movable arcing contact which moves over a path from one point in contact with the inner periphery of the cylindrical electrode to a point central of the cylindrical electrode.

While the prior art arrangements may be useful to provide current interrupting devices for general purposes and for use in circuit breakers, these arrangements are relatively large and cumbersome and do not lend themselves for use in distribution switchgear where small size and the visibility of an open switch gap is desirable.

SUMMARY OF THE INVENTION

Accordingly, it is a principal object of the present invention to provide a rotating arc interrupter that is small and provides an easily visible open gap.

It is another object of the present invention to provide a rotating arc interrupter for a loadbreak switch which utilizes a main stationary contact that is positioned in the middle of an arc runner and a shunt contact that bridges the arc runner and that is above and coplanar with the main stationary contact.

It is a further object of the present invention to provide a magnetic interrupter device utilizing a shunt contact that causes the arcing current to develop a magnetic field to extinguish the are.

These and other objects of the present invention are efficiently achieved by the provision of a loadbreak switch which utilizes a pivotally mounted movable jaw contact and a main stationary contact that is positioned in the middle of an arc runner. For operation at voltages 15 kV and above, the switch utilizes a shunt contact that bridges the arc runner and that is above and coplanar with the main stationary contact. A magnetic field is developed by the current that flows through a coil of wire disposed around the arc runner. This configuration when utilized in an environment of insulating gas, provides efficient extinguishing of arcs upon opening of the contacts. Further, the open jaw contact is easily visible to establish an open gap.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
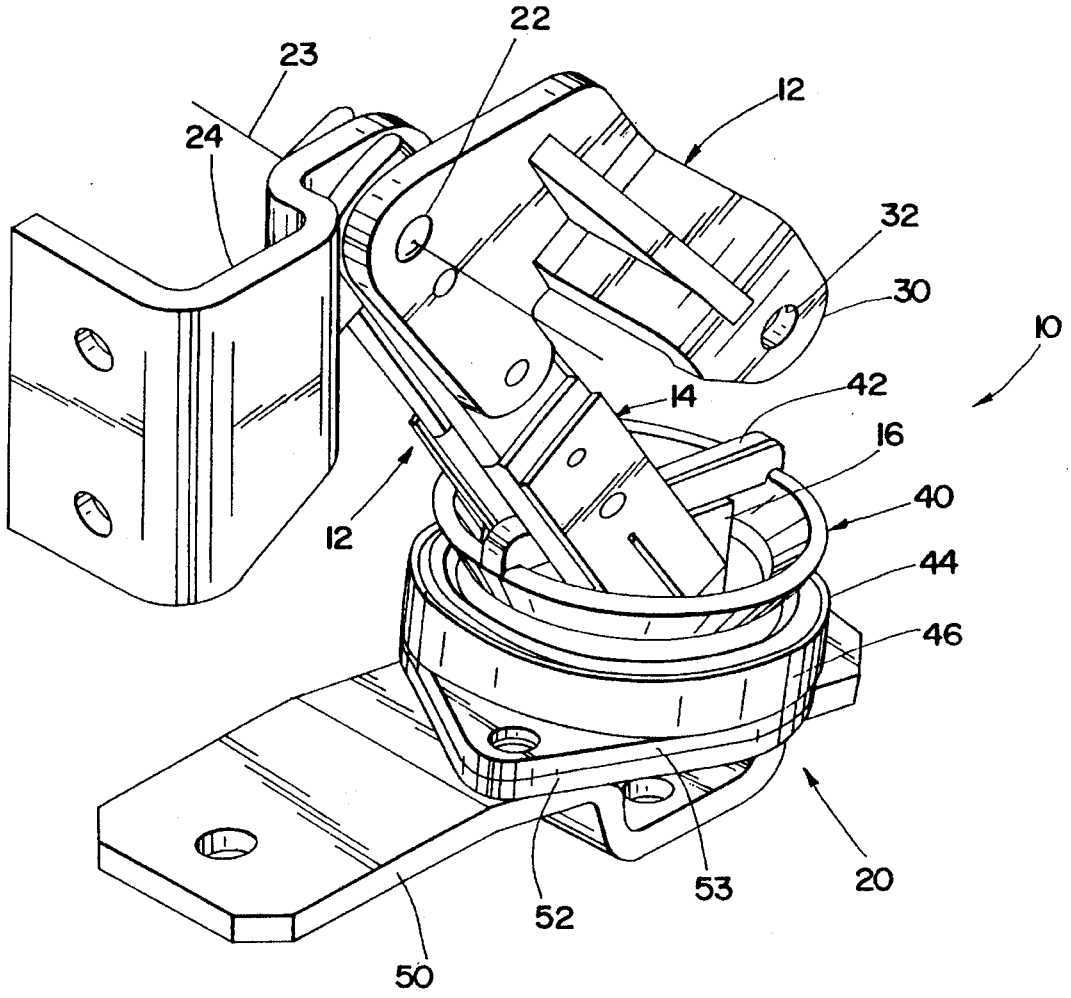
FIG. 1 is a perspective view of a rotating arc interrupter switch in accordance with the principles and features of the present invention, and shown in the closed position.
Figure 2:
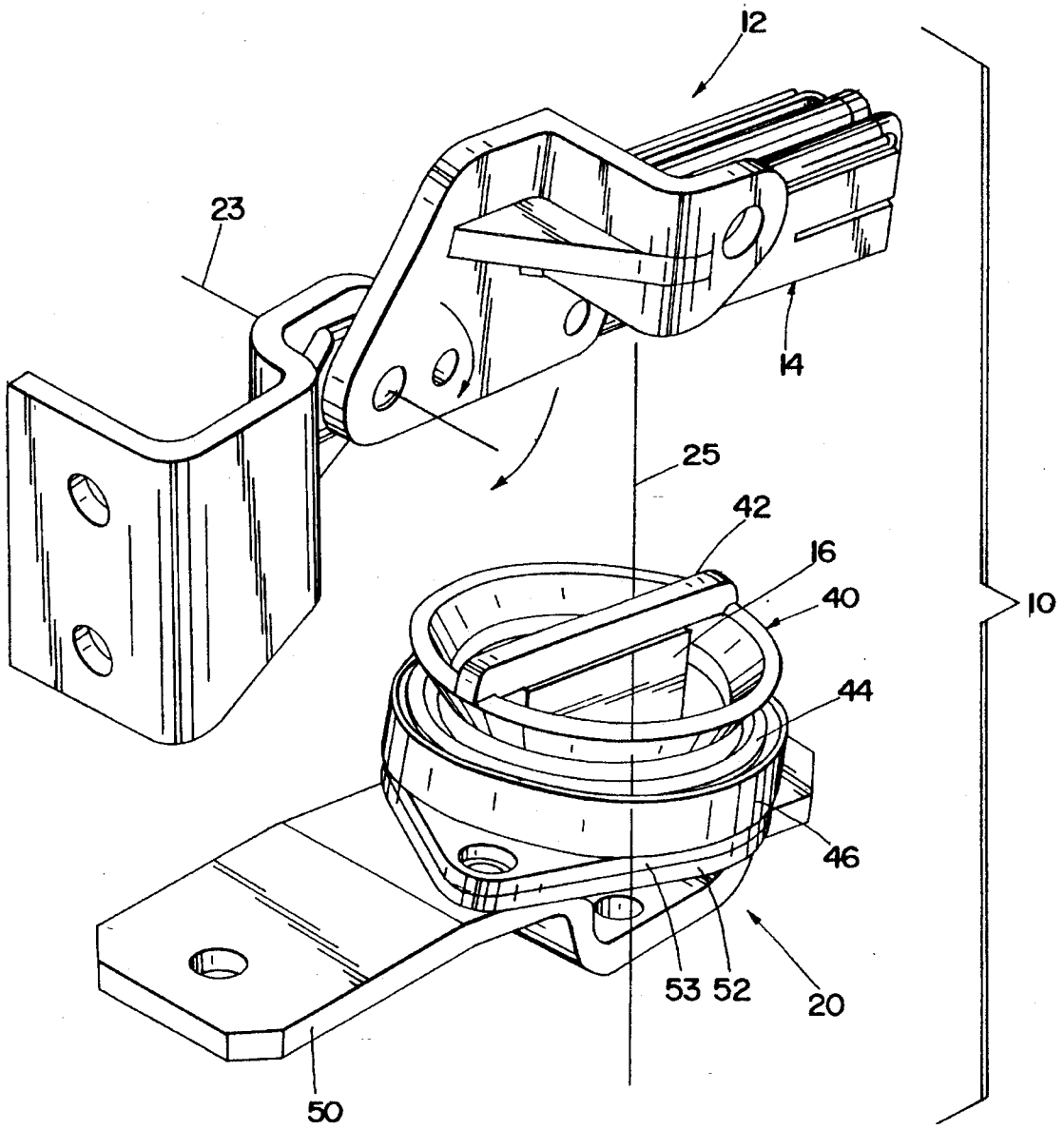
FIG. 2 is a perspective view of the rotating arc interrupter switch of FIG. 1 shown in the open position.
Figure 3:
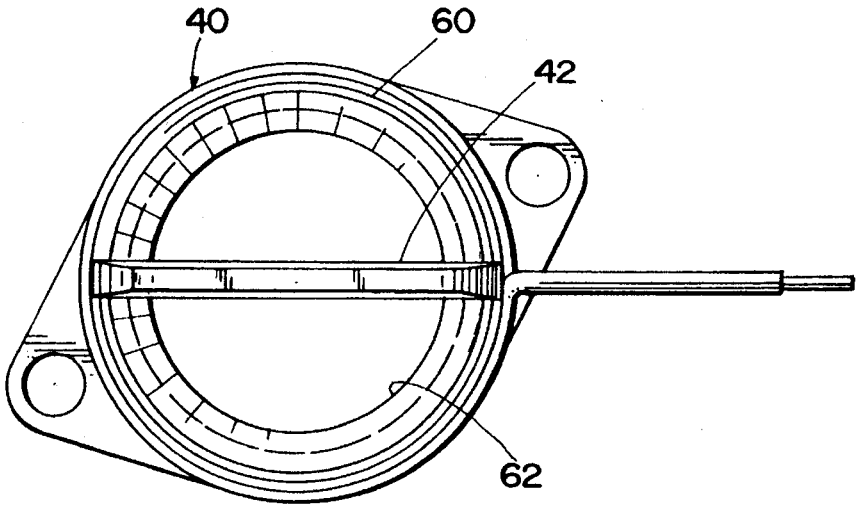
FIGS. 3 and 4 are top plan and front elevational views respectively of an arc runner assembly of the rotating arc interrupter of FIGS. 1 and 2.
Figure 4:
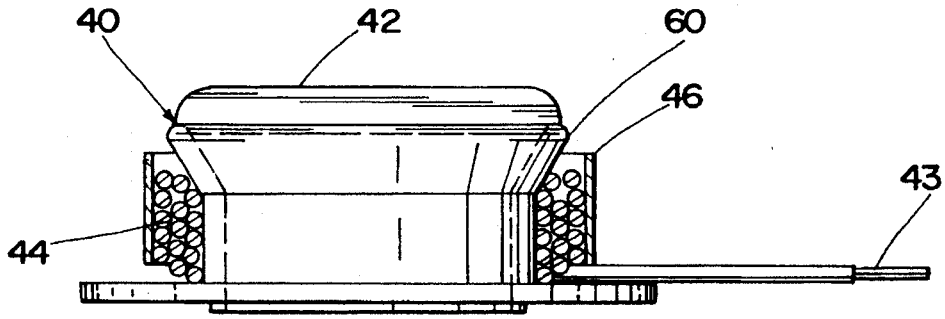
Figure 5:
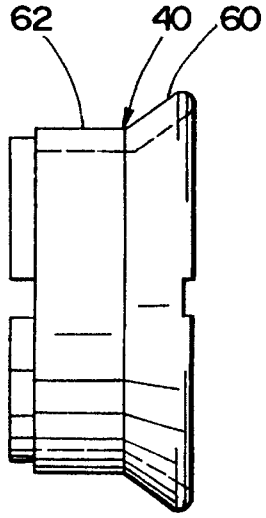
FIG. 5 is an elevational view of an arc runner of the arc runner assembly of FIGS. 3 and 4.
Figure 7:
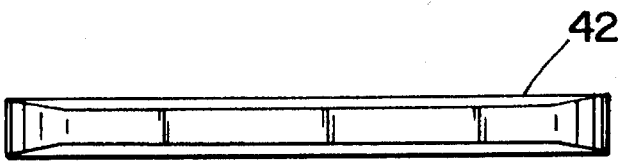
FIGS. 6–8 are front elevational, top plan, and right-side elevational views respectively of a shunt contact of the rotating arc interrupter of FIGS. 1–4.
Figure 6:
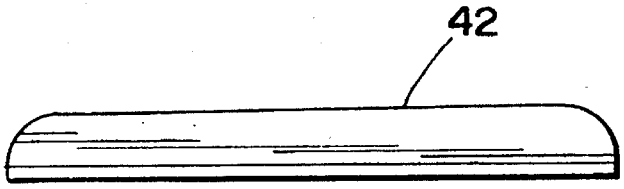
Figure 8:
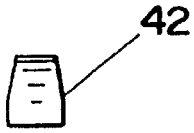

Referring now to FIGS. 1 and 2, a loadbreak switch 10 that is illustrative of the principles of the present invention includes a pivotally mounted movable contact assembly 12 with jaw contact assembly 14 and a stationary main contact 16. The stationary main contact 16 is located in the middle of a rotating arc interrupter assembly 20. The loadbreak switch 10 is illustrated in FIG. 1 in the closed position wherein the jaw contact assembly 14 makes electrical circuit connection with the stationary main contact 16. In FIG. 2, the movable contact assembly 12 is pivoted into the circuit open position wherein the jaw contact assembly 14 is disengaged from the stationary contact assembly 16. In the open position of FIG. 2, there is established an easily visible open gap between the movable contact assembly 12 and the stationary main contact 16 and the rotating arc interrupter assembly 20. The movable contact assembly is pivotally supported about a pin 22 carried by a mounting bracket or support 24, defining a pivot axis 23. The movable contact assembly 12 also includes a drive arm 30 having an aperture 32 for attachment to a drive linkage (not shown). The rotating arc interrupter assembly 20 establishes a magnetic field during circuit-opening of the jaw contact assembly 14 from the stationary contact 16 to cause the arc to spin along the rotating arc interrupter assembly 20 and to be extinguished with the aid of an environment of insulating gas, for example $SF_6$, in which the switch 10 is arranged to be operated.

Figure 9:
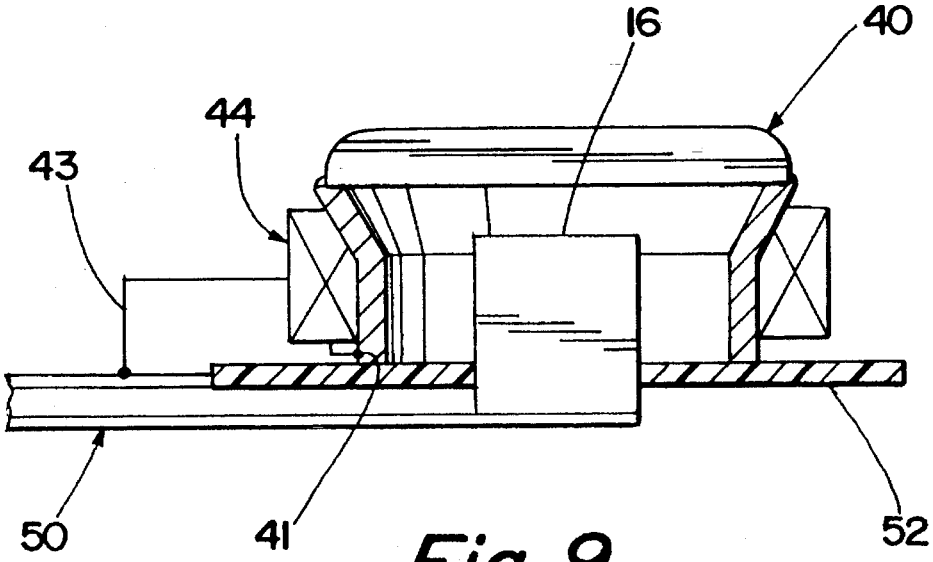
FIG. 9 is a diagrammatic representation of the electrical and magnetic circuits of the rotating arc interrupter of FIGS. 1–8.

The arc interrupter assembly 20 includes a generally cylindrical arc runner 40 that is conductive and that defines a central axis 25. For operation at voltages at 15 kV and higher, a shunt contact 42 is provided that bridges and extends above the arc runner 40. The stationary main contact 16 is positioned within the arc runner 40 and below and coplanar with the shunt contact 42 so as to form a predetermined gap between the main contact 16 and the shunt contact 42. A winding 44 is carried around the circumference of the arc runner 40 and a retaining ring 46 is provided about the winding 44 and the arc runner 40. Referring additionally to FIG. 9, the stationary main contact 16 is connected to a main contact bus 50. The winding 44 has one end 41 connected to the arc runner 40 and the second end 43 connected to the main contact bus 50. The arc runner 40 is insulated from the main contact bus 50 by an insulating plate 52 positioned below the arc runner 40. Preferably, a rigid retainer plate 53 is positioned atop the insulating plate 52 to resist any developed forces on the insulating plate 52.

In operation, when the jaw contact assembly 14 is pivoted about the axis 23 so as to move from the main contact 16, the jaw contact assembly 14 makes contact with the shunt contact 42. As the jaw contact 14 continues to move and is no longer in contact with the main contact 16, the current is diverted through the arc runner 40 and into the winding 44 establishing a magnetic field. When the jaw contact 14 parts from the shunt contact 42, an arc is drawn and the arc moves along periphery of the arc runner 40 and because of the magnetic field into the $SF_6$ environment and is extinguished. The arc can not move or jump back onto the main contact 16 because this path would require that the arc move past the shunt contact 42 which will not occur since the shunt contact provides the path. Thus, the magnetic field is always present throughout arcing to move the arc through the gaseous environment surrounding the arc runner 40. During closing of the switch 10, an arc is first established between the shunt contact 42 and the jaw contact 14 thus protecting the main contact 16 from arcing, especially during any fault closing. Further, since the shunt contact 42 is not in the continuous current path in the closed position, the shunt contact 42 can be fabricated from an arc resistance material such as copper tungsten. Accordingly, the shunt contact 42 during opening mechanically commutates the current into the coil 44 to provide short interrupting times and also ensures that the arc current will continue into the winding 44 once the arc is established. Further, during closing, the shunt contact 42 shields the main contact 16 since the jaw contact 14 first contacts the shunt contact 42 before the main contact 16. The axis 25 of the arc runner 40 is transverse and generally perpendicular to the pivot axis 23 of the jaw contact 14.

In accordance with important aspects of the preferred embodiment of the present invention, the arc runner 40 includes an outwardly flared section 60 defining a conical surface at its upper end proximal the shunt contact 42. In a specific embodiment, the section 60 forms an angle of approximately 35 degrees with respect to the inner wall of the arc runner 40. The outwardly flared section 60 allows the diameter of the arc runner 40 to be minimized while still providing clearance for the jaw contact 14 to rotate out of the arc runner 40 at the appropriate angle. For example, in a specific embodiment, the jaw contact when engaged with the stationary contact forms an angle of approximately 40 degrees with the axis of the arc runner 40. This provides several advantages. The minimum size of the diameter of the arc runner 40 allows the smallest overall phase spacing for polyphase switches. Further, the relatively lower angle of the jaw contact 14 with respect to the axis 25 of the arc runner 40 allows the overall spacing to the pivot point 22 and thus the overall expanse of the switch 10 to be minimized. Additionally, to maximize the fault-closing capability of the switch 10, the winding 44 must be appropriately sized since the winding 44 carries the fault current for the short duration of time between pre strike and the time the jaw contact 14 makes contact with the stationary contact 16. For example, to accommodate in excess of 10,000 amperes of fault closing current, in a specific embodiment the winding 44 is made of 15 turns of #10AWG solid, varnish-coated copper wire. The wire in the winding 44 also adds to the overall phase spacing such that the minimum diameter of the lower straight walled cylindrical portion 62 of the arc runner 40 is a desirable feature. As an illustration, for the switch 10 operating in the range of 15–34.5 kV and providing in excess of 600 amperes loadbreak capability, the overall dimension of the arc interrupter assembly 20 is less than 3.5 inches.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A rotating arc interrupter comprising:

movable contact means movable between open and closed positions;

a generally planar stationary contact being engaged by said movable contact means in said closed position; and means for commutating current flow away from said stationary contact and for generating a magnetic field arranged to extinguish arcing current in response to said movable contact means moving out of said closed position toward said open position, said commutating means comprising first contact means arranged coplanar with said stationary contact and second contact means being defined about a generally open volume, said stationary contact being disposed within said second contact means, said first contact means being arranged so as to be contacted by said movable contact means as said movable contact means moves out of said closed position and before said movable contact means disengages said stationary contact.

2. The rotating arc interrupter of claim 1 wherein said movable contact means comprises a movable contact blade and means for pivotally mounting said movable contact blade.

3. The rotating arc interrupter of claim 1 wherein said movable contact means comprises a contact blade that moves over an arcuate path with respect to said stationary contact.

4. The rotating arc interrupter of claim 2 wherein said second contact means further comprises a generally cylindrical arcing element with said stationary contact arranged within said cylindrical arcing element.

5. The rotating arc interrupter of claim 4 wherein said first contact means is arranged to bridge said cylindrical arcing element.

6. The rotating arc interrupter of claim 5 wherein said commutating means further comprises magnetic field generating means disposed about said cylindrical arcing element and electrically connected between said cylindrical arcing element and said stationary contact.

7. The rotating arc interrupter of claim 6 wherein said cylindrical arcing element includes an outwardly flared top section.

8. An interrupter for use in an insulating-gas environment comprising:

movable contact means movable between open and closed positions;

a stationary contact being engaged by said movable contact means in said closed position;

a shunt contact being spaced from said stationary contact and being engaged by said movable contact means during separation of said movable contact means from said stationary contact; and first means responsive to current through said shunt contact for generating a magnetic field to extinguish arcing currents, said first means comprising a cylindrical conductive member disposed about said stationary contact and a winding disposed about said cylindrical conductive member, said shunt contact being positioned to bridge said cylindrical conductive member, said winding having one end connected to said cylindrical conductive member and a second end electrically connected in common with said stationary contact, said cylindrical conductive member including an upper surface having an outwardly flared rim across which said shunt contact is positioned.

9. The interrupter of claim 8 wherein said shunt contact and said stationary contact are coplanar.

10. A rotating arc interrupter for a loadbreak switch comprising:

a generally cylindrical arc runner;

a shunt contact positioned to bridge the center of said arc runner;

a stationary main contact positioned below said shunt contact and being arranged generally coplanar therewith; and a conductive winding carried about and electrically insulated from said arc runner, a first end of said winding being electrically connected to said arc runner, said second end of said winding being electrically connected to said main contact.

11. The rotating arc interrupter of claim 10 wherein said arc runner has an outwardly flared section in contact with said shunt contact.

12. The rotating arc interrupter of claim 10 further comprising a main contact bus positioned below said arc runner and in contact with said stationary main contact, and an insulating member disposed between said arc runner and said main contact bus.

13. An interrupter comprising:

movable contact means movable between open and closed positions;

a stationary contact being engaged by said movable contact means in said closed position;

a shunt contact being spaced from said stationary contact and being engaged by said movable contact means during separation of said movable contact means from said stationary contact; and first means responsive to current through said shunt contact for generating a magnetic field to extinguish arcing currents, said first means comprising a generally cylindrical conductive member disposed about said stationary contact and a conductive winding disposed about and electrically insulated from said generally cylindrical conductive member, said winding having one end connected to said generally cylindrical conductive member and a second end electrically connected in common with said stationary contact, said shunt contact being positioned substantially across the center of said generally cylindrical conductive member.

14. The interrupter of claim 13 wherein said cylindrical conductive member includes an upper surface having an outwardly flared rim across which said shunt contact is positioned.

15. A rotating arc interrupter for a loadbreak switch comprising:

a generally cylindrical arc runner;

a shunt contact spanning said arc runner;

a stationary main contact positioned within said arc runner; and a conductive winding carried about and electrically insulated from said arc runner, a first end of said winding being electrically connected to said arc runner, said second end of said winding being electrically connected to said main contact.

16. A rotating arc interrupter for a loadbreak switch comprising:

a stationary main contact;

a generally cylindrical arc runner disposed about said stationary main contact;

a shunt contact positioned substantially across the central portions of said arc runner; and a conductive winding carried about and electrically insulated from said arc runner, a first end of said winding being electrically connected to said arc runner, said second end of said winding being electrically connected to said main contact.

* * * * *